US006897882B1

(12) United States Patent
Kim

(10) Patent No.: US 6,897,882 B1
(45) Date of Patent: May 24, 2005

(54) VISUAL OUTPUT DEVICE AND METHOD FOR PROVIDING A PROPER IMAGE ORIENTATION

(75) Inventor: Young-Chan Kim, Anyang (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 303 days.

(21) Appl. No.: 09/722,040

(22) Filed: Nov. 27, 2000

(30) Foreign Application Priority Data

Jun. 28, 2000 (KR) ..... 2000-36015

(51) Int. Cl.[7] ..... G09G 5/00

(52) U.S. Cl. ..... 345/659; 345/661; 345/676; 345/649; 345/297

(58) Field of Search ..... 345/659, 661, 345/676, 649, 297; 382/297

(56) References Cited

U.S. PATENT DOCUMENTS 5,329,289 A 7/1994 Sakamoto et al.
5,566,098 A 10/1996 Lucente et al.
5,923,528 A 7/1999 Lee
5,963,215 A * 10/1999 Rosenzweig ..... 345/437
6,400,851 B1 * 6/2002 Shih ..... 382/297

FOREIGN PATENT DOCUMENTS

| | | |
|---|---|---|
| JP | 6-164973 | 6/1994 |
| JP | 9-083981 | 3/1997 |
| JP | 10-124007 | 5/1998 |
| JP | 11-202847 | 7/1999 |

* cited by examiner

*Primary Examiner*—Matthew C. Bella
*Assistant Examiner*—Tam Tran
(74) *Attorney, Agent, or Firm*—Robert E. Bushnell, Esq.

(57) ABSTRACT

A pivoting digital video display device having a pivot apparatus and a PIP function. The pivot apparatus rotates an image from a TV, VTR or DVD for PIP display so that the PIP display can be shown in the same orientation as the main display to provide a user with normal displays, when a personal computer generates a rotated main video signal in response to the rotation of the digital display apparatus from a latitudinal orientation to a longitudinal orientation. Additionally, the pivot apparatus rotates an image corresponding to the main video signal when the personal computer does not generate a rotated main video signal in response to the rotation of the digital display apparatus from a latitudinal orientation to a longitudinal orientation.

13 Claims, 7 Drawing Sheets

VISUAL OUTPUT DEVICE AND METHOD FOR PROVIDING A PROPER IMAGE ORIENTATION

CLAIM OF PRIORITY

This application makes reference to, incorporates the same herein, and claims all benefits accruing under 35 U.S.C §119 from an application entitled Pivot Apparatus Of A Digital Video Display Device Having PIP Function earlier filed in the Korean Industrial Property Office on 28 Jun. 2000, and there duly assigned Serial No. 2000-36015 by that Office.

BACKGROUND OF THE INVENTION

1. Field of the Invention

1 The present invention relates to a pivot apparatus of a digital video display device having a PIP (picture-in-picture) function, and more particulary to a pivot apparatus of a digital video display device having a PIP function, enabling a PIP display to be viewed in the same direction as a main display.

2. Description of the Related Art

Video display devices having diverse additional functions together with basic functions are readily available on the market, such additional functions being, for example, a PIP function or a pivotal display function.

In general, the PIP function is a screen editing function for simultaneously showing a main display and PIP displays on the screen of one video display device, such as displaying one television channel on a main display area of the screen and another television channel in a sub-display area, i.e., PIP area. With respect to the present invention the PIP function simultaneously displays on the main display a video image input from a personal computer and in the PIP display area a video image input from various signal sources such as a TV, VTR, DVD, and the like.

With respect to the pivot function, to a screen editing function changes the appearance of the displayed image to accommodate the viewer when a video display device is rotated between a lateral (horizontal: horizontal size of image is greater than vertical size) direction and a longitudinal (vertical: vertical size of image is greater than horizontal size) direction. Accordingly, when an image representing, for example, a page of a word processing document is transmitted to a video display device positioned laterally, the viewer will see only a portion of the page, then if the display device is to be positioned longitudinally by rotating to device 90° the screen editing function may change the appearance of the displayed image so that the viewer can see the whole page.

Example of such pivoting or rotatable display devices are provided by Japanese Patent Publication 9-083981 to Ikeda Koji and entitled Picture Communication Equipment; U.S. Pat. No. 5,329,289 to Kohichiro Sakamoto et al. and entitled Data Processor With Rotatable Display; U.S. Pat. No. 5,566,098 to Samuel A. M. Lucente et al and entitled Rotatable Pen-Based Computer With Automatic Reorienting Display; and U.S. Pat. No. 5,923,528 to Roger Lee and entitled Pivotal Apparatus For Flat Display.

SUMMARY OF THE INVENTION

It is an object of the present invention to provide pivot apparatus and method of a video display device having a PIP function, capable of showing PIP displays in the same orientation (direction) as the main display.

In order to achieve the above object, the pivot apparatus according to the present invention comprises a main controller for outputting a main control signal to rotate a PIP display 90° if a command is input by a user; a first signal converter for inputting a 90° rotated main display video signal from a personal computer and converting the 90° rotated main display video signal into a main digital signal; a second signal converter inputs a PIP display video signal from a TV, a VCR, or a DVD and converts the PIP display video signal into a PIP digital signal; a pivot processor for inputting and rotating the PIP digital signal from the second signal converter 90° based on the main control signal; a PIP processor for inputting the 90° rotated main display digital video signal from the first signal converter and the 90° rotated PIP display digital video signal from the pivot processor and superimposing the main display and the PIP display in a set resolution, based on the main control signal; and a panel driver for inputting the superimposed display video signal from the PIP processor for a display on a panel.

In order to achieve the above object, another pivot apparatus according to the present invention comprises a main controller for outputting a main control signal to rotate a main display and a PIP display 90° if a command is input by a user; a first signal converter for inputting a main display video signal from a personal computer and converting the main display video signal into a main digital signal; a second signal converter for inputting a PIP display video signal from a TV, a VCR, or a DVD and converting the PIP display video signal into a PIP digital signal; a pivot processor for inputting and rotating the digital-converted main display video signal from the first signal converter 90° and inputting and rotating the PIP digital signal from the second signal converter 90°, based on the main control signal; a PIP processor for inputting the 90° rotated main display digital video signal and the 90° rotated PIP display digital video signal from the pivot processor and superimposing the 90° rotated main display digital video signal and the 90° rotated PIP display digital video signal in a set resolution, based on the main control signal; and a panel driver for inputting the superimposed display video signals from the PIP processor for a display on a panel.

Accordingly, in order to carry out a PIP function or a pivot function at the same time, the PIP displays are rotated 90° to be superimposed with a main display, or both the main display and the PIP displays are rotated 90° to be superimposed, so that the PIP displays can be shown in the same direction as the main display, to thereby provide a user with normal displays.

BRIEF DESCRIPTION OF THE DRAWINGS

A more complete appreciation of the present invention, and many of the attendant advantages thereof, will become readily apparent as the same becomes better understood by reference to the following detailed description when considered in conjunction with the accompanying drawings in which like reference symbols indicate the same or similar components, wherein:

FIG. 3(*b*) is a block diagram for showing a pivot apparatus of a digital video display device having a PIP function according to a second embodiment of the present invention;

FIG. 4(*b*) is a view for showing a detailed block diagram of a pivot processor of FIG. 3(*b*)

DETAILED DESCRIPTION OF THE PREFERRED EMBODIMENTS

Figure 1:
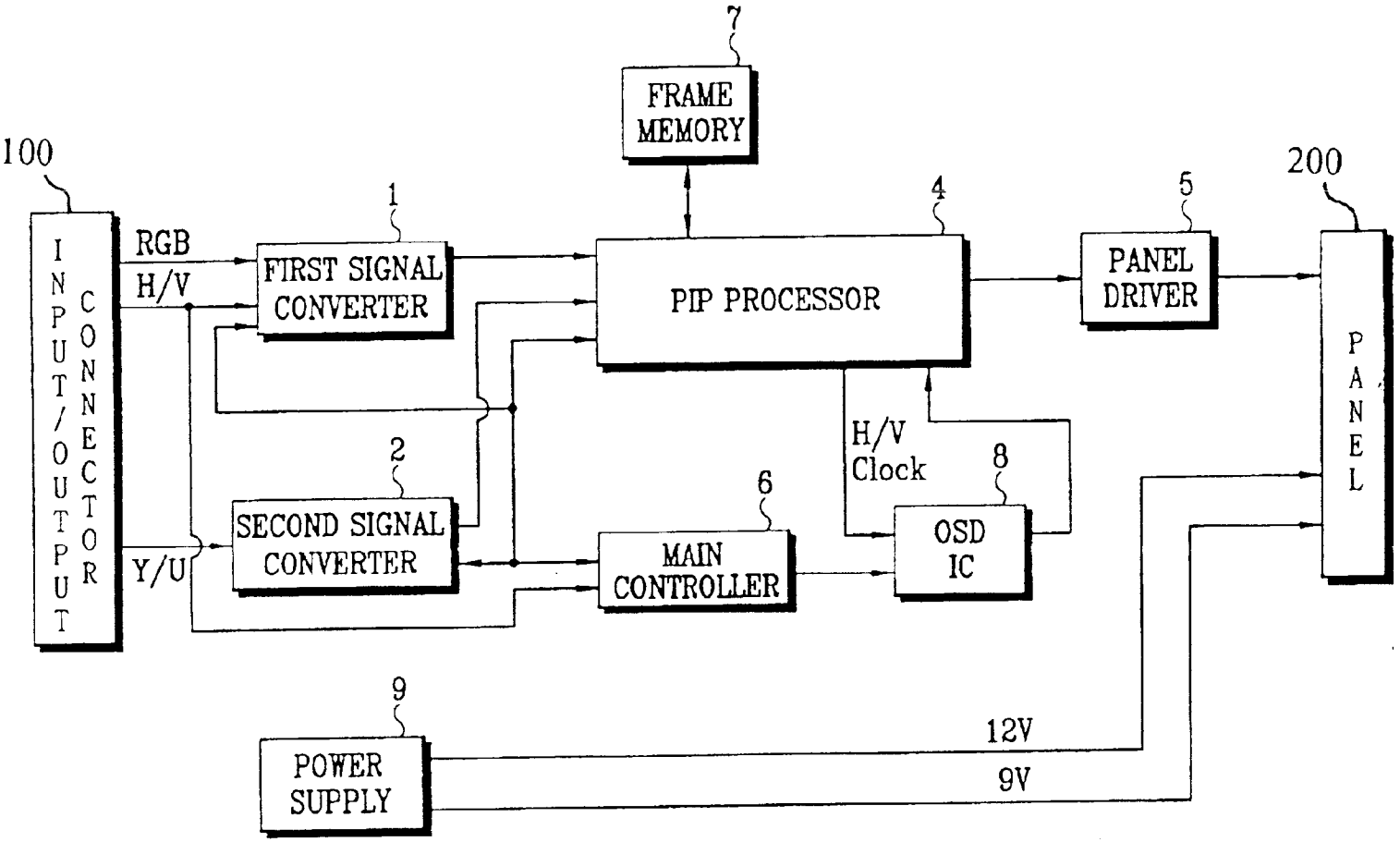
FIG. 1 is a block diagram for showing a digital video display device having a PIP function.

FIG. 1 is a block diagram for showing a digital video display device having an exemplary PIP function. As shown in FIG. 1, a digital video display device having a PIP function includes a first signal converter 1, a second signal converter 2, a PIP processor 4, a panel driver 5, a main controller 6, a frame memory 7, an OSD (on-screen display) IC 8, a power supply 9, an input/output connector 100 connecting the display device to a personal computer (not shown) a TV, a VCR, or a DVD, and a panel (or screen) 200 for displaying an image.

Describing the operations of a digital video display device having a PIP function, first of all, the first signal converter 1 receives a main display video signal from a personal computer and converts the main display video signal into a digital signal, and the second signal converter 2 inputs a PIP display video signal from a TV, a VCR, or a DVD and converts the PIP display video signal into a digital signal.

At this time, if the main controller 6 outputs a control signal to carry out a PIP function, the PIP processor 4 inputs the main display digital video signal from the first signal converter 1 and inputs the PIP display digital video signal from the second signal converter 2 based on the control signal to superimpose the main display and the PIP display in a set resolution.

Figure 2A:
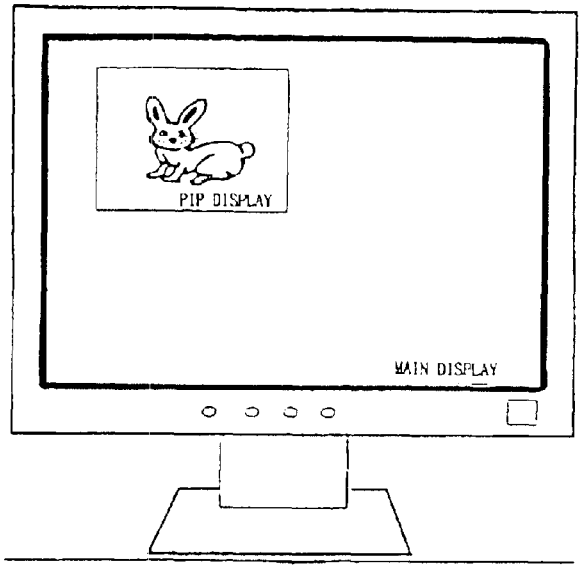
FIGS. 2(*a*)–2(*c*) are views for explaining the display of a PIP image in digital video display devices having a PIP function.
Figure 2B:
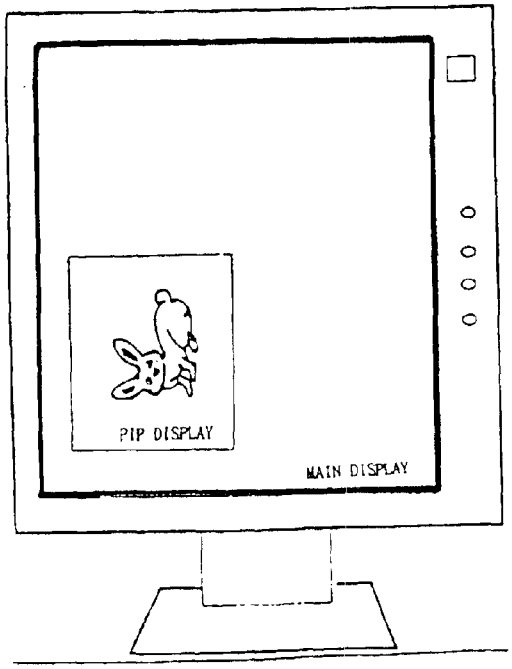
Figure 2C:
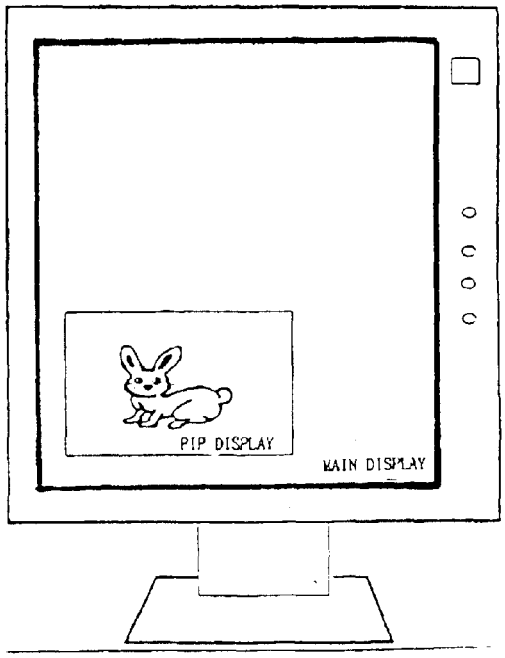

Accordingly, the panel driver 5 receives the superimposed display from the PIP processor 4 for display as shown in FIG. 2(*a*), wherein the video display device is laterally positioned and the main display area shows an input from a personal computer and the PIP display area shows an image input from a TV, a VTR, or a DVD, and the like.

If the display device of FIG. 1 included a pivot function, as currently known in the art, then when the user places the video display device in the longitudinal direction, or longitudinally, the main display area would show an image, being input from personal computer, in proper orientation for viewing by the viewer, but the image shown in the PIP display area, being input from the TV, VTR or DVD, would not be properly oriented for viewing and would thus appear to be in a 90° rotated state, as shown in FIG. 2(*b*), instead of the proper orientation of FIG. 2(*c*).

Hereinafter, the first and second embodiments of the present invention will be described.

Figure 3A:
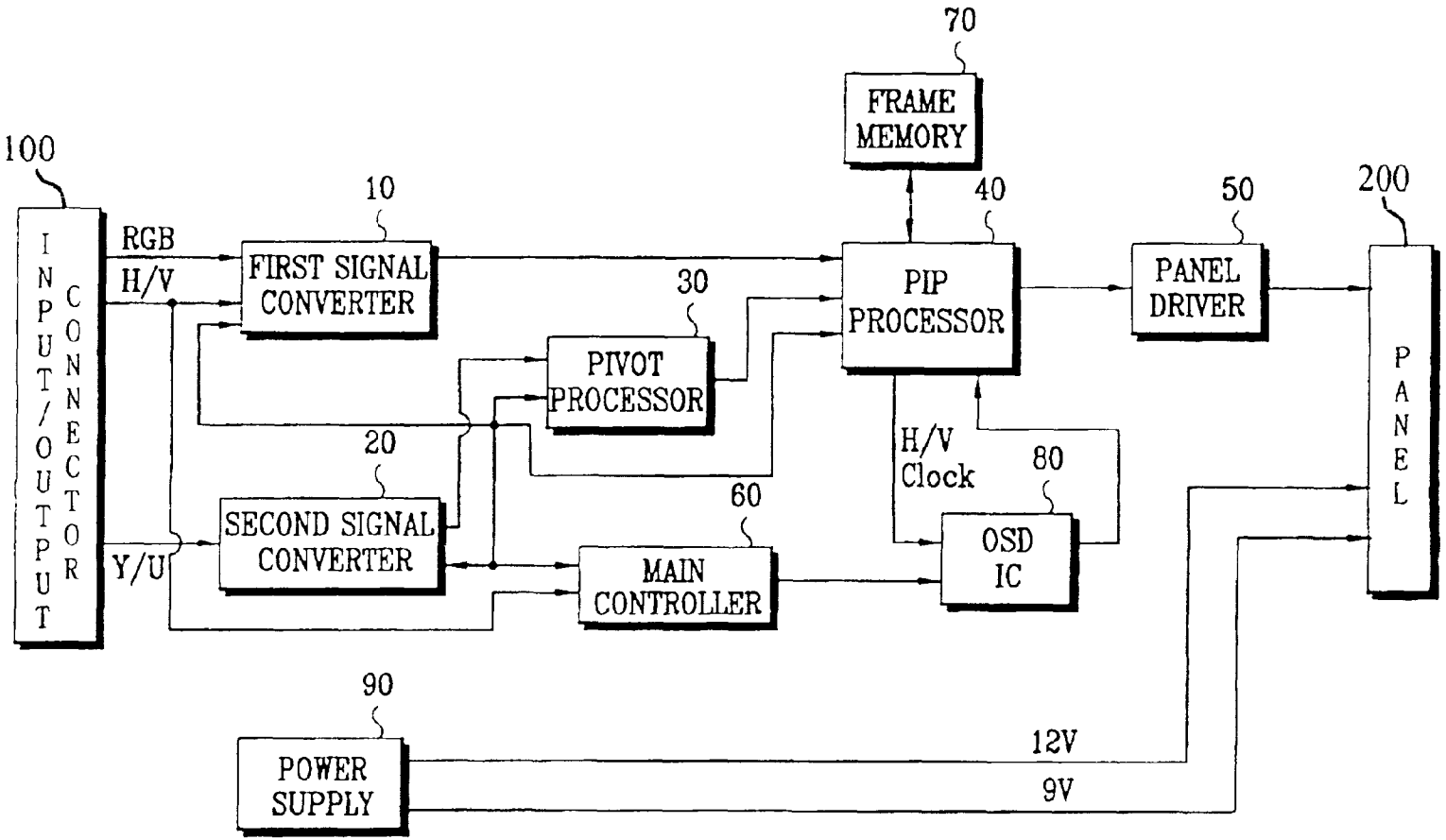
FIG. 3(*a*) is a block diagram for showing a pivot apparatus of a digital video display device having a PIP function according to a first embodiment of the present invention.
Figure 3B:
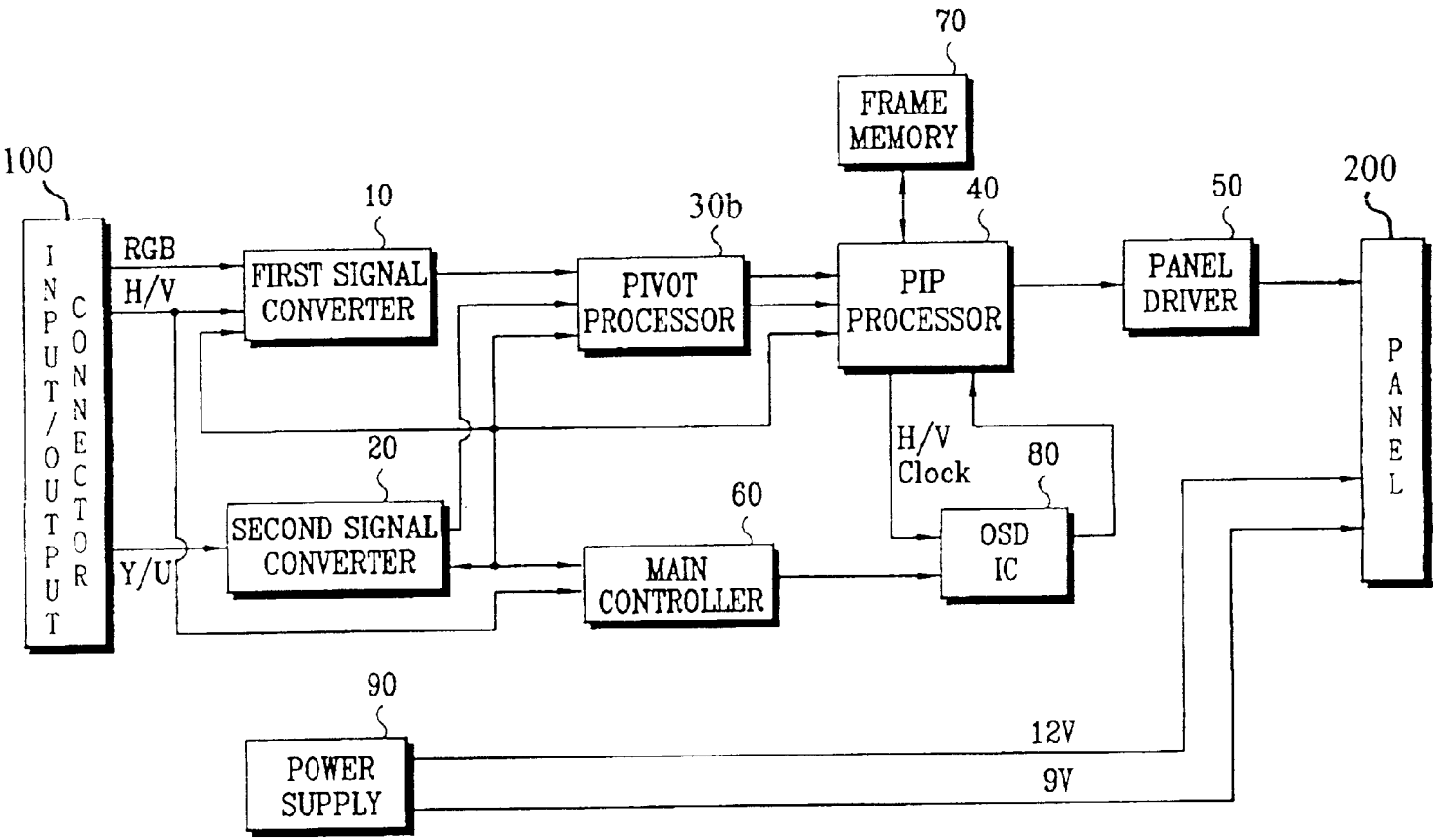
Figure 4A:
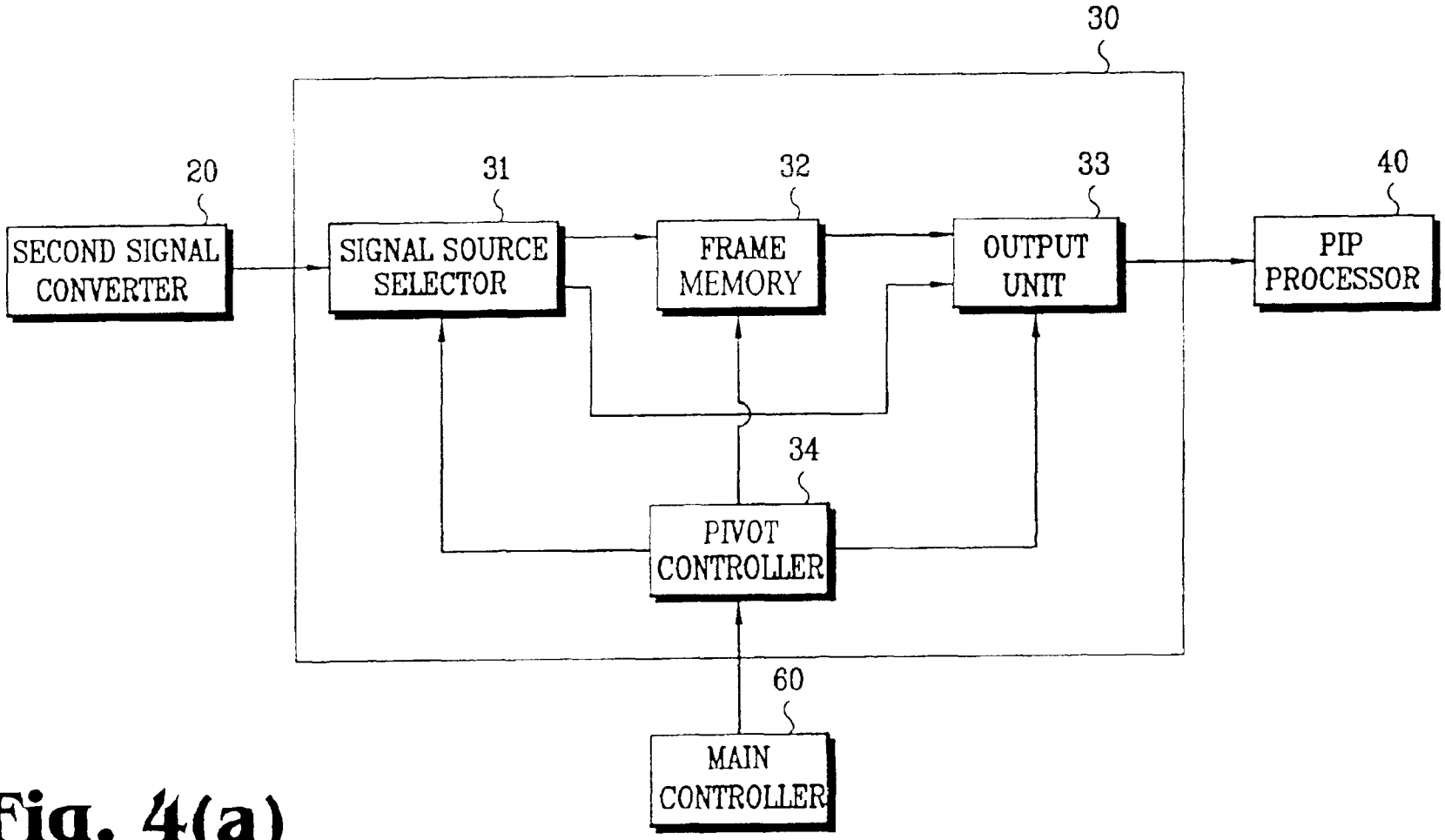
FIG. 4(*a*) is a view for showing a detailed block diagram of a pivot processor of FIG. 3(*a*)
Figure 4B:
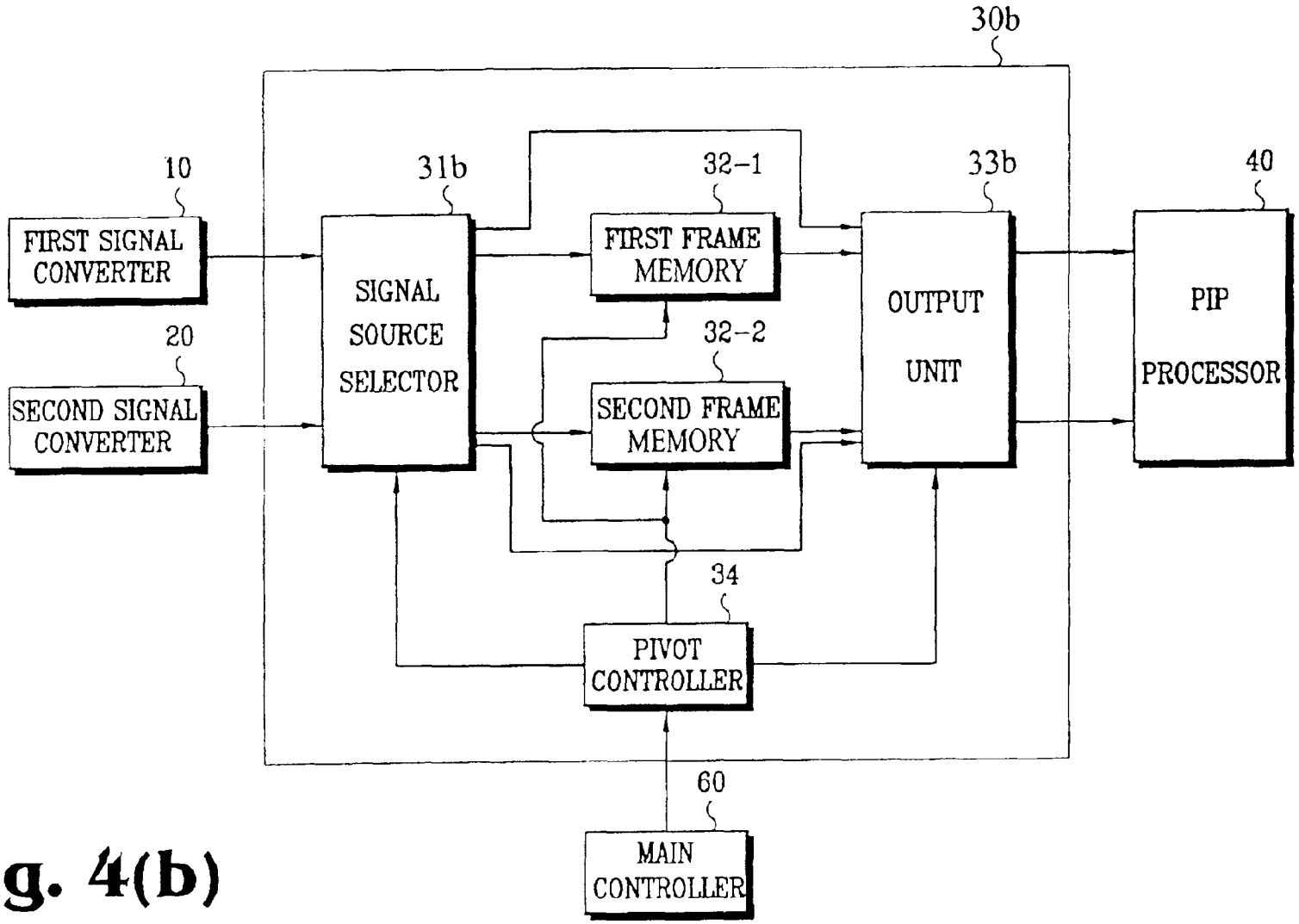

FIG. 3(*a*) is a block diagram for showing a pivot apparatus of a digital video display device having a PIP function according to a first embodiment of the present invention, FIG. 3(*b*) is a block diagram for showing a pivot apparatus of a digital video display device having a PIP function according to a second embodiment of the present invention, FIG. 4(*a*) is a view for showing a detailed block diagram of a pivot processor of FIG. 3(*a*), and FIG. 4(*b*) is a view for showing a detailed block diagram of a pivot processor of FIG. 3(*b*).

The first embodiment of the present invention includes, as shown in FIG. 3(*a*), a main controller 60 for outputting a main control signal to rotate a PIP display 90° in response to a command input by a user is; a first signal converter 10 for inputting a main display video signal, rotated 90°, from a personal computer and converting the main display video signal into a digital signal; a second signal converter 20 for inputting a second display video signal from a TV, a VTR, or a DVD, for use as PIP display video signal, and converting the second display video signal into a second digital signal; a pivot processor 30 for inputting and rotating the digital-converted second display video signal, from the second signal converter 20, 90° based on the main control signal from main controller 60; a PIP processor 40 for inputting the 90° rotated main display digital video signal from the first signal converter 10 and the 90° rotated second display digital video signal from the pivot processor 30 based on the main control signal and superimposing the main display and the second display in a set resolution, wherein the second display is a PIP display; and a panel driver 50 for inputting the superimposed video signal from the PIP processor 40 for display on a panel 200.

Here, the pivot processor 30, as shown in FIG. 4(*a*), includes a signal source selector 31 for selectively outputting, to a frame memory 32 or an output unit 33, the second display video signal input from the second signal converter 20 based on a selection control signal; frame memory 32 for 90° rotating and temporarily storing the second display video signal selectively output from the signal source selector 31; output unit 33 for outputting a 90° rotated second display video signal written from the frame memory 32 when an enable control signal is applied thereto from a pivot controller 34, or outputting the second display video signal input from the signal source selector 31 when an enable control signal is not applied thereto; and pivot controller 34 for outputting a signal source selection signal to the signal source selector 31, controlling the writing of the second display video signal output from the signal source selector 31 to a certain address of frame memory 32 according to a set order, controlling the reading of the 90° rotated second display video signal from frame memory 32 according a set order for input to output unit 33, and outputting the enable control signal to the output unit 33 based on a control of the main controller 60.

Further, a second embodiment of the present invention includes, as shown in FIG. 3(*b*), a main controller 60 for outputting a main control signal to rotate a main display and a PIP display 90° in response to a command input from a user; a first signal converter 10 for inputting a main display video signal from a personal computer and converting the inputted main display video signal into a digital signal; a second signal converter 20 for inputting a display video signal from a TV, a VCR, or a DVD, for use as PIP display video signal, and converting the input display video signal into a second digital signal; a pivot processor 30*b* for inputting and 90° rotating the digital-converted main display video signal from the first signal converter 10, and inputting and 90° rotating the digital-converted second display video signal from the second signal converter 20, based on the main control signal; a PIP processor 40 for inputting the 90° rotated main display digital video signal from the pivot processor 30*b* and the 90° rotated second display digital video signal, and superimposing the 90° rotated main display and the 90° rotated second display in a set resolution, wherein the 90° rotated second display is a PIP display, based on the main control signal; and a panel driver 50 for inputting the superimposed display video signal from the PIP processor 40 for a display on a panel.

Here, the pivot controller 30*b* includes, as shown in FIG. 4(*b*), a signal source selector 31*b* for selectively outputting, to a first frame memory 32-1 or to an output unit 33*b*, a main display video signal input from the first signal converter 10, and selectively outputting, to a second frame memory 32-2 or to an output unit 33*b*, the second display video signal provided from the second signal converter 20 based on a selection control signal; the first frame memory 32-1 90° rotating and temporarily storing the main display video signal output from the signal source selector 31*b*; the second frame memory 32-2 for 90° rotating and temporarily storing the second display video signal selectively output from the signal source selector 31*b*; the output unit 33*b* for outputting the 90° rotated main display video signal and the 90° rotated second display video signal written from the first frame memory 32-1 and the second frame memory 32-2, respectively, when an enable control signal is applied to output unit 33*b*, and outputting the main display video signal and the second display video signal input from the signal source selector 31*b*, respectively, if an enable control signal is not applied to output unit 33*b*; and a pivot controller 34 for outputting a signal source selection signal to the signal source selector 31*b*, controlling the writing of the main display video signal and the second display video signal output from the signal source selector 31*b* to certain addresses, respectively, of the first and second frame memories 32-1 and 32-2 according to a set order, and controlling the reading and transmitting to the output unit 33*b* the 90° rotated main display video signal from the first frame memory 32-1 and the 90° rotated second display video signal from the second frame memory 32-2 according to a set order, and outputting the enable control signal to the output unit 33*b*, based on a control of the main controller 60.

Next, the first and second embodiments of the present invention as structured above will be respectively described as follows.

At this time, the first embodiment is for 90° rotating a second video signal to be displayed as a PIP video signal when a main video signal 90° rotated by the software of a personal computer is input to a video display device, and the second embodiment is for 90° rotating both a main video signal and a second video signal when the main video signal is not 90° rotated by the software of a personal computer.

A. First Embodiment

First of all, as shown in FIG. 3(*a*), the first signal converter 10 inputs a 90° rotated main display video signal from a personal computer and converts the main display video signal into a main digital signal, the second signal converter 20 receives a second display video signal (referred to hereafter as: a PIP display video signal) from a TV, a VCR, or a DVD and converts the PIP display video signal into a PIP digital signal.

That is, the first signal converter 10 converts an RGB color signal input from a personal computer to the main digital signal, and the second signal converter 20 separates a composite video signal inputted from a TV, a VCR, or a DVD into a luminance signal (Y) and a color difference signal (U), decodes the separated luminance signal (Y) and color difference signal (U) into a decoded RGB color signal, and converts the decoded RGB color signal into the PIP digital signal.

At this time, if a command is input from a user, the main controller 60 outputs a main control signal to rotate the PIP digital signal 90°. Accordingly, the pivot controller 30 inputs and 90° rotates the PIP digital signal from the second signal converter 20 based on the main control signal.

Describing the operation of the pivot processor 30 with reference to FIG. 4(*a*) in more detail, the pivot controller 34 outputs a signal source selection signal to the signal source selector 31 based on a control of the main controller 60. The signal source selector 31 selectively outputs the PIP digital signal, provided from the second signal converter 20, to frame memory 32 or output unit 33, based on the selection signal.

Accordingly, the pivot controller 34 writes the PIP digital signal output from the signal source selector 31 to a certain address of the frame memory 32 according to a set order based on a control of the main controller 60 and reads the 90° rotated PIP digital signal from frame memory 32 for input to the output unit 33 according to the set order for transmission.

Figure 5A:
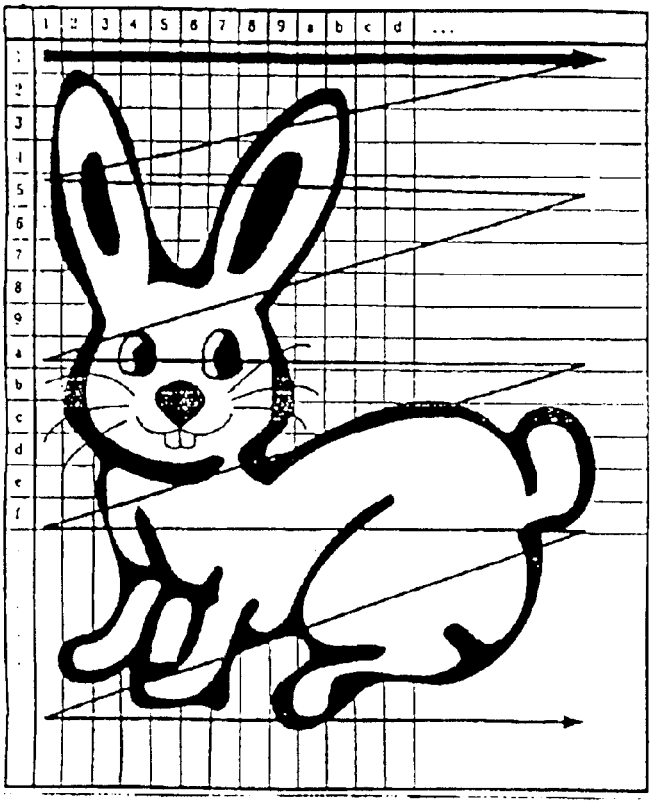
FIGS. 5(*a*) and 5(*b*) are views for explaining the order of data inputted to a pivot processor and the order of data written into a frame memory.
Figure 5B:
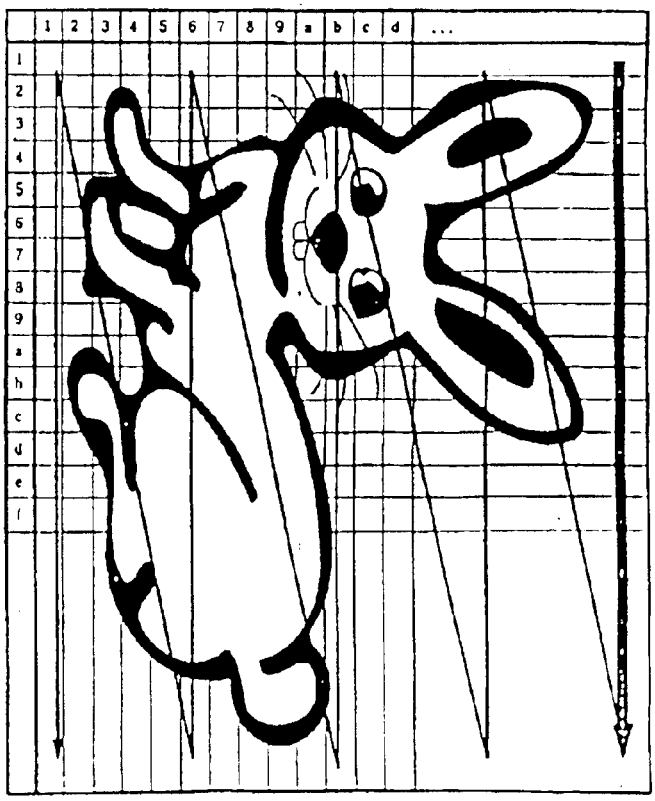

That is, if the data input to the pivot processor 34 has the set order (resolution) as shown in FIG. 5*a*, the order to be written to the frame memory 32 becomes the 90° rotated state as shown in FIG. 5*b*. For example, as shown in FIG. 5*b*, writing one frame data to the frame memory 32 is carried out from an address at the right upper position to an address at the left lower position in the longitudinal direction. The frame memory 32 is for 90° rotating and storing the PIP digital signal selectively output from the signal source selector 31.

In the meantime, the pivot controller 34 selectively outputs an enable control signal to the output unit 33. Accordingly, the output unit 33 outputs the 90° rotated PIP digital signal output from the frame memory 32 if the enable control signal is applied to pivot controller 34, and outputs the PIP digital signal input from the signal source selector 31 if the enable control signal is not applied to pivot controller 34. That is, the output unit 33 selectively outputs the 90° rotated PIP digital signal and the non-rotated PIP digital signal to the PIP processor 40, based on the enable control signal.

In the meantime, the PIP processor 40 receives a 90° rotated main digital signal from the first signal converter 10 and the PIP digital signal from the pivot processor 30, to be superimposed, respectively, on a main display area and a PIP display area in a set resolution, based on the main control signal.

At this time, in order to display the superimposed display digital signals on panel 200, the PIP processor 40 writes the superimposed display digital signals to allocated regions of frame memory 70 in a set order, reads the superimposed display digital signals from the allocated regions of frame memory 70, and transmits the read superimposed signals from frame memory 70 to panel 200.

Then, panel driver 50 receives the superimposed display digital signals from the PIP processor 40 and outputs the signals for display on a panel 200.

B. Second Embodiment

First of all, as shown in FIG. 3(*b*), the first signal converter 10 inputs a main display video signal from a personal computer and converts the main display video signal into a main digital signal, and the second signal converter 20 inputs a PIP display video signal from a TV, a VCR, or a DVD, and converts the PIP display video signal into a PIP digital signal.

That is, the first signal converter 10 converts an RGB color signal input from the personal computer into a main digital signal, and the second signal converter 20 separates a composite video signal input from a TV, a VCR, or a DVD into a luminance signal Y and a color difference signal U, decodes the separated luminance signal Y and the color difference signal U into an RGB color signal, and converts the decoded RGB color signal into the PIP digital signal.

At this time, if a command is input from a user, the main controller 60 outputs a main control signal in order to rotate both a main digital signal and a PIP digital signal 90°.

Accordingly, the pivot controller 30*b* inputs and rotates the main digital signal from the first signal converter 10 90°, and inputs and rotates the PIP digital signal from the second signal converter 20 90°, based on the main control signal.

Describing the operations of the pivot processor 30*b* in more detail with reference to FIG. 4(*b*), the pivot controller 34 outputs a signal source selection signal to the signal source selector 31*b* based on a control of the main controller 60.

The signal source selector 31*b* selectively outputs, to first frame memory 32-1 or to output unit 33*b*, the main display video signal input from the first signal converter 10, and selectively outputs, to second frame memory 32-2 or to output unit 33*b*, the PIP digital signal provided from the second signal converter 20, based on a selection control signal.

Accordingly, when the images are to be displayed on panel 200 in a rotated state, the pivot controller 34 writes the main digital signal and the PIP digital signal output from the signal source selector 31*b*, according to a set order, into certain addresses of the first frame memory 32-1 and the second frame memory 32-2, respectively, based on a control of the main controller 60, and respectively reads and transmits to the output unit 33*b* the 90° rotated main digital signal and the 90° rotated PIP digital signal from the first frame memory 32-1 and the second frame memory 32-2.

That is, if the data input to the pivot processor 30*b* has an order as shown in FIG. 5*a*, the order of the data written into the frame memories becomes a 90° rotated state as shown in the FIG. 5*b*.

For example, as shown in FIG. 5*b*, writing one frame of data into the first frame memory 32-1 or the second frame memory 32-2 is carried out from an address at the right upper position to an address at the left lower position in the longitudinal direction.

The first frame memory 32-1 is for temporarily storing the 90° rotated main digital signal and the second memory 32-2 is for temporarily storing the 90° rotated PIP digital signal.

In the meantime, the pivot controller 34 outputs an enable control signal to the output unit 33*b* when the images are to be displayed on panel 200 in a rotated state.

Accordingly, the output unit 33*b* outputs, if the enable control signal is applied thereto, the 90° rotated main digital signal and the 90° rotated PIP digital signal respectively read from the first frame memory 32-1 and the second frame memory 32-2, and outputs, if the enable control signal is not applied thereto, the main digital signal and the PIP digital signal received from the signal source selector 31*b*.

That is, the output unit 33*b* selectively outputs to the PIP processor 40 the main digital signal and the PIP digital signal prior to a 90° rotation or the main digital signal and the PIP digital signal after a 90° rotation based on whether or not the enable control signal is applied to output unit 33*b* from pivot controller 34.

In the meantime, the PIP processor 40 receives the main digital signal and the PIP digital signal from the pivot processor 30*b* and superimposes the signals such that main digital signal is displayed on the main display area of panel 200 and the PIP digital signal is displayed on PIP display are of panel 200 in a set resolution, when output unit 33*b* does not receive the enable control signal.

However, when output unit 33*b* receives the enable control signal, the PIP processor 40 receives the 90° rotated main digital signal and the 90° rotated PIP digital signal from the pivot processor 30*b* and superimposes the signals such that 90° rotated main digital signal is displayed on the main display area of panel 200 and the 90° rotated PIP digital signal is displayed on PIP display area of panel 200 in a set resolution.

At this time, in order to display the superimposed display digital signals on panel 200, the PIP processor 40% writes the superimposed display digital signals to allocated regions of frame memory 70 in a set order, reads the superimposed display digital signals from the allocated regions of frame memory 70, and transmits the read superimposed signals from frame memory 70 to panel 200.

Then, panel driver 50 receives the superimposed display digital signals from the PIP processor 40 and outputs the signals for display on a panel 200.

As described above, the present invention 90° rotates a PIP display in order to simultaneously carry out the PIP function and the pivot function and superimposes the 90° rotated PIP display with a main display, or 90° rotates both the main display and the PIP display and superimposes the 90° rotated main display and PIP display, so that the PIP display can be shown in the same orientation as the main display to provide a user with normal displays.

What is claimed is:

1. A visual output device including a display screen for visually outputting images input from at least one external image source, said visual output device being enclosed in a housing, at least a portion of which defines a peripheral frame of said display screen, said at least a portion of said housing and said display screen being rotatable together to selectively place said visual output device in one of at least a first viewing orientation and a second viewing orientation, said visual output device comprising:

at least one input interface disposed in said housing, said at least one input interface being configured to be accessible to said at least one external image source, and to receive therefrom an image suitable for displaying in said first viewing orientation;

a pivot process circuitry disposed within said housing, said pivot process circuitry being in operable communication with said at least one input interface, and being configured to selectively convert said image into a rotated image suitable for displaying in said second viewing orientation, to thereby cause said image received from said at least one external image source to be displayed on said display screen in a proper viewing orientation.

2. The visual output device according to claim 1, wherein said display screen comprises at least a first viewing area and a second viewing area, said at least one input interface comprising at least a first input interface and a second input interface for receiving a main image and a secondary image respectively from a first external source and a second external source, said pivot process circuitry being configured to selectively rotate at least one of said main image and said secondary image from a first image orientation suitable for display in said first viewing orientation to a second image orientation suitable for display in said second viewing orientation to produce at least one of a rotated main image and a rotated secondary image, said visual output device further comprising:

a picture-in-picture process circuitry configured to produce a combined display signal comprising a combination of at least two of said main image, said secondary image, said rotated main image and said rotated secondary image; and a screen drive circuitry configured to receive said combined display signal from said picture-in-picture process circuitry, and to drive said display screen according to said combined display signal so as to cause at least one of said main image and said rotated main image to be displayed in said first viewing area of said display screen simultaneously with at least one of said secondary image and said rotated secondary image being displayed in said second viewing area of said display screen.

3. The visual output device according to claim 1, wherein said pivot process circuitry comprises:

a memory having a plurality of addressable storage locations, said pivot process circuitry being configured to selectively convert said image by writing said image selectively in one of a first predetermined order of said plurality of addressable locations and a second predetermined order of said plurality of addressable locations.

4. The visual output device according to claim 1, wherein said pivot process circuitry selectively converts said image into said rotated image based on an indicated desire for viewing said image in said second viewing orientation, said indicated desire comprising an input from a viewer of said visual output device.

5. A visual output device including a display screen for visually outputting images input from at least a first external image source and a second external image source, said visual output device being enclosed in a housing, at least a portion of which defines a peripheral frame of said display screen, said at least a portion of said housing and said display screen being rotatable together to selectively place said visual output device in one of at least a first viewing orientation and a second viewing orientation, said display screen including a main viewing area and at least a first secondary viewing area, said visual output device comprising:

a first input interface disposed in said housing, said first input interface being configured to receive a main image from said first external image source;

a second input interface disposed in said housing, said second input interface being configured to receive a secondary image, suitable for displaying in said first viewing orientation, from said second external image source;

a pivot process circuitry disposed within said housing, said pivot process circuitry being in operable communication with said first input interface and said second input interface, and being configured to selectively rotate, for viewing in said second viewing orientation, at least one of said main image and said secondary image into at least one of a rotated main image suitable for displaying in said second viewing orientation and a rotated secondary image suitable for displaying in said second viewing orientation, respectively, such that said main image and said secondary image are in the same orientation;

a picture-in-picture process circuitry configured to produce a combined display signal comprising a combination of at least two of said main image, said secondary image, said rotated main image and said rotated secondary image; and a screen drive circuitry configured to receive said combined display signal from said picture-in-picture process circuitry, and to drive said display screen according to said combined display signal so as to cause at least one of said main image and said rotated main image to be displayed in said main viewing area of said display screen simultaneously with at least one of said secondary image and said rotated secondary image being displayed in said secondary viewing area of said display screen.

6. The visual output device according to claim 5, wherein:

said main image is suitable for display in said second viewing orientation when received by said first input interface, wherein said pivot process circuitry is configured to rotate said secondary image to produce said rotated secondary image, and wherein said combined display signal comprises a combination of said main image and said rotated secondary image, both of which being suitable for displaying in said second viewing orientation.

7. The visual output device according to claim 5, wherein said pivot process circuitry comprises:

a memory having a plurality of addressable storage locations, said pivot process circuitry being configured to selectively convert said image by writing said image selectively in one of a first predetermined order of said plurality of addressable locations and a second predetermined order of said plurality of addressable locations.

8. The visual output device according to claim 5, wherein said pivot process circuitry is configured to selectively rotate at least one of said main image and said secondary image in response to an input from a viewer of said visual output device, said input indicating a desire to view said at least one of said main image and said secondary image in said second viewing orientation.

9. A method of orienting images in a visual output device, said visual output device being enclosed in a housing, at least a portion of which defines a peripheral frame of a display screen, said at least a portion of said housing and said display screen being rotatable together to selectively place said visual output device in one of at least a first viewing orientation and a second viewing orientation, said method comprising:

receiving, by a first input interface disposed within said housing, a main image, suitable for display in said first viewing orientation, from a first external image source; and selectively rotating, within said housing, for viewing in said second viewing orientation, said main image into a rotated main image suitable for displaying in said second viewing orientation, to thereby cause said main image received from said first external image source to be displayed on said display screen in a proper viewing orientation, when said portion of said housing and said display screen are rotated to place said visual output device in said second viewing orientation.

10. The method of orienting images in accordance with claim 9, further comprising:

receiving, by a secondary input interface disposed within said housing, a secondary image from a second external image source;

selectively rotating, within said housing, based on an indicated desire for viewing in said second viewing orientation, said secondary image into a rotated secondary image suitable for displaying in said second viewing orientation; and combining at least two of said main image, said secondary image, said rotated main image and said rotated secondary image; and driving said display screen according to said combined display signal so as to cause at least one of said main image and said rotated main image to be displayed in a first viewing area of said display screen simultaneously with at least one of said secondary image and said rotated secondary image being displayed in a second viewing area of said display screen.

11. The method of orienting images in accordance with claim 9, wherein said step of selectively rotating said main image comprises:

writing said main image selectively in one of a first predetermined order of a plurality of addressable locations of a memory and a second predetermined order of said plurality of addressable locations of said memory.

12. The method of orienting images in accordance with claim 10, wherein said step of selectively rotating said secondary image comprises:

writing said secondary image selectively in one of a first predetermined order of a plurality of addressable locations of a memory and a second predetermined order of said plurality of addressable locations of said memory.

13. The method of orienting images in accordance with claim 10, further comprising:

receiving a user input from a viewer of said visual output device, said user input indicating an indicated desire for viewing said secondary image in said second viewing orientation.

* * * * *